US007435101B2

(12) United States Patent
Yoneta et al.

(10) Patent No.: US 7,435,101 B2
(45) Date of Patent: Oct. 14, 2008

(54) ELECTRICAL CONNECTION MEMBER FOR CONNECTION BETWEEN OBJECTS TO BE CONNECTED

(75) Inventors: Akane Yoneta, Tokyo (JP); Hiroshi Akimoto, Tokyo (JP); Takeshi Takahashi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/703,960

(22) Filed: Feb. 8, 2007

(65) Prior Publication Data

US 2007/0190820 A1 Aug. 16, 2007

(30) Foreign Application Priority Data

Feb. 9, 2006 (JP) ..... 2006-032739

(51) Int. Cl.
*H01R 12/00* (2006.01)

(52) U.S. Cl. ..... 439/67; 439/91

(58) Field of Classification Search ..... 439/66, 439/67, 91

See application file for complete search history.

(56) References Cited

U.S. PATENT DOCUMENTS 4,706,097 A * 11/1987 Harmon ..... 346/139 C
4,975,068 A * 12/1990 Squires ..... 439/67
5,059,129 A * 10/1991 Brodsky et al. ..... 439/67
5,273,440 A * 12/1993 Ashman et al. ..... 439/71
5,873,740 A * 2/1999 Alcoe et al. ..... 439/67
5,947,750 A * 9/1999 Alcoe et al. ..... 439/67
6,036,502 A * 3/2000 Neidich et al. ..... 439/67
6,077,090 A * 6/2000 Campbell et al. ..... 439/67
6,520,789 B2 * 2/2003 Daugherty et al. ..... 439/329

FOREIGN PATENT DOCUMENTS

| | | | |
|---|---|---|---|
| JP | 57-109580 | * | 7/1982 |
| JP | 58-51485 | * | 3/1983 |
| JP | 6-60930 | * | 3/1994 |
| JP | 6076876 | | 3/1994 |
| JP | 8-88062 | * | 4/1996 |
| JP | 8-203583 | * | 8/1996 |
| JP | 2005-340153 | * | 12/2005 |

OTHER PUBLICATIONS

Japanese Office Action dated Jun. 18, 2008 in Japanese Application No. 2006-032739 (With Summary Translation of same).*

* cited by examiner

*Primary Examiner*—Tho D Ta
(74) *Attorney, Agent, or Firm*—Collard & Roe, P.C.

(57) ABSTRACT

An electrical connection member includes a base sheet, an insulating first elastic body arranged on one surface of the base sheet, and an insulating film having a first part 31*a* arranged on the first elastic body. The first part 31*a* has a first contact point for contact with a first object to be connected. The first elastic body has a plurality of first protrusions protruding toward the first contact point.

9 Claims, 7 Drawing Sheets

ELECTRICAL CONNECTION MEMBER FOR CONNECTION BETWEEN OBJECTS TO BE CONNECTED

This application claims priority to prior Japanese patent application JP 2006-32739, the disclosure of which is incorporated herein by reference.

BACKGROUND OF THE INVENTION

The present invention relates to an electrical connection member for connecting two objects to be connected by means of a flexible film having contact points.

Japanese Unexamined Patent Application Publication (JP-A) No. H06-76876 (Patent Publication 1) discloses a connector in which fine parallel line patterns having conductivity are formed on a film surface.

This connector is formed by folding a film so as to sandwich a plate-shaped rubber-like elastic body with the conductive patterns exposed outside, and fixing the rubber-like elastic body to the film. The connector is interposed between two objects to be connected and the objects to be connected are pressed against the connector, whereby connection is established between the patterns on the film and the objects to be connected.

If any of the objects to be connected is warped or deformed, however, the connector described in Patent Publication 1 is not able to follow the warpage or deformation.

Accordingly, the connector will sometimes not be able to obtain enough force required for contact, inducing a problem of instable contact state.

If the film and the rubber-like elastic body are assembled together in the condition where they are positionally misaligned with each other, the connector will not be able to obtain enough force required for contact, inducing a problem of instable contact state.

Further, when a product to be produced has conductive patterns having different intervals in the pitch direction from those of the rubber-like elastic body, a molding die is required for each pitch to form a rubber-like elastic body, leading to a problem of increased production man-hours and cost.

SUMMARY OF THE INVENTION

It is therefore an object of the present invention to provide an electrical connection member capable of establishing an electrically stable contact state.

It is another object of the present invention to provide an electrical connection member capable of reducing the man-hours and cost required for production of parts and components thereof.

According to this invention, there is provided an electrical connection member for electrically connecting first and second objects to be connected to each other, comprising a base sheet, an insulating first elastic body arranged on one surface of the base sheet, and an insulating film having a first part arranged on the first elastic body, the first part having a first contact point for contact with the first object to be connected, and the first elastic body having a plurality of first protrusions protruding toward the first contact point.

DESCRIPTION OF THE PREFERRED EMBODIMENTS

Figure 1:
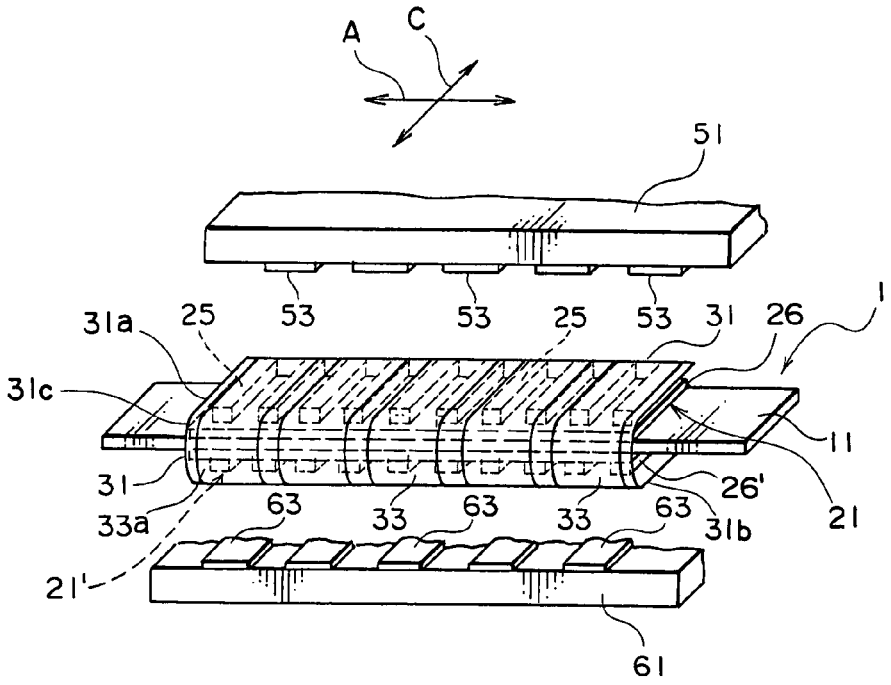
FIG. 1 is a perspective view of an electrical connection member according to a first embodiment of the present invention, partially showing two objects to be connected to the electrical connection member.
Figure 2:
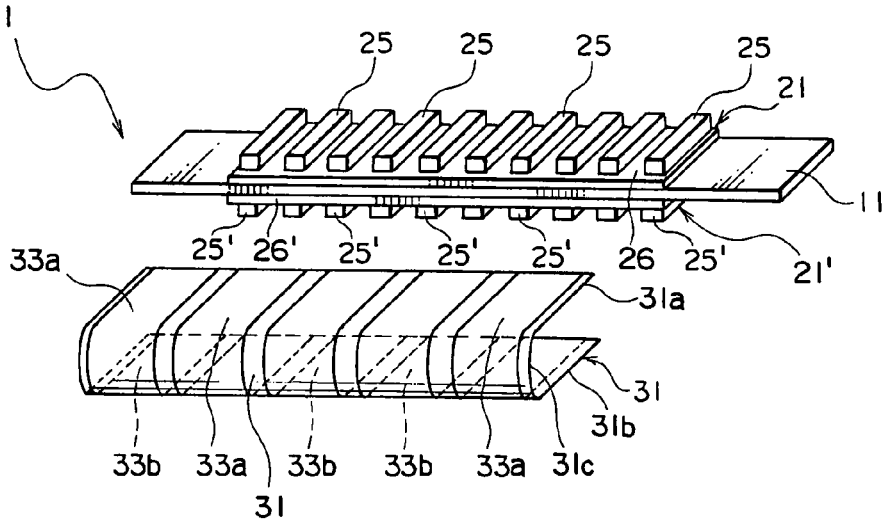
FIG. 2 is a perspective view illustrating the electrical connection member shown in FIG. 1 in an exploded view.

FIG. 1 shows an electrical connection member according to a first embodiment of the present invention. In addition to the electrical connection member, FIG. 1 shows two objects to be connected to the electrical connection member in the state before the connection. FIG. 2 shows the electrical connection member of FIG. 1 in an exploded view.

Referring to FIGS. 1 and 2, the electrical connection member 1 includes an insulating base sheet 11, an insulating first elastic body 21 arranged on one surface of the base sheet 11, and an insulating film 31 having a first part 31*a* arranged on the first elastic body 21.

The base sheet 11 has a long plate shape. The first part 31*a* of the film 31 has a first contact point 33*a* for contact with a printed wiring board 51 that is one of the objects to be connected shown in FIG. 1.

The first elastic body 21 has a plurality of first protrusions 25 protruding toward the first contact point 33*a*, and a first plate 26 linking the plurality of first protrusions 25 with each other.

The first protrusions 25 are arranged in parallel and with a space from each other on one surface of the first plate 26.

The film 31 has a second part 31*b* facing the opposite face of the base sheet 11, and a U-shaped cross-sectional part 31*c* linking the first and second parts 31*a* and 31*b* together.

The second part 31*b* of the film 31 has a second contact point 33*b* connected to the first contact point 33*a*. The second contact point 33*b* is a portion to be in contact with a printed wiring board 61 that is the other object to be connected shown in FIG. 1.

The electrical connection member 1 further has an insulating second elastic body 21' arranged between the base sheet 11 and the second part 31*b*. The second elastic body 21' is arranged on the other surface of the base sheet 11.

Since the second elastic body 21' has the same configuration as that of the first elastic body 21, the description hereafter will be made while adding a prime symbol (') to the reference numerals for the parts and components of first elastic body 21.

The second elastic body 21' has a plurality of second protrusions 25' protruding toward the second contact point 33*b*, and a second plate 26' linking the second protrusions 25'.

The second protrusions 25' are arranged in parallel and with a space from each other on one surface of the second plate 26'.

In the following description, a first direction A parallel to the longitudinal direction of the first and second elastic bodies 21 and 21' will be referred to as the pitch direction A, and a second direction C orthogonal to the pitch direction A on one surface of the first and second elastic bodies 21 and 21' will be referred to as the crosswise direction C.

The first plate 26 is integral with the first protrusions 25. All the first protrusions 25 have a quadrangular prismatic shape. This means that the first protrusions 25 of the first elastic body 21 are substantially protruded, as viewed in the cross sections vertical to the pitch direction A and to the crosswise direction C.

The plurality of the first protrusions 25 are arranged with a space from each other in the pitch direction A on one surface of the first plate 26. Further, the first protrusions 25 are arranged on one surface of the first plate 26 such that the longitudinal direction thereof is in parallel with the crosswise direction C.

A plurality of the second protrusions 25' are arranged with a space from each other in the pitch direction A on the opposite surface of the second plate 26'. Further, the second protrusions 25' are arranged on the opposite surface of the second plate 26' such that the longitudinal direction thereof is parallel with the crosswise direction C.

The film 31 is made of a flexible material. The film 31 is formed so as to be wrapped over the first elastic body 21 arranged on one surface of the base sheet 11 and the second elastic body 21' arranged on the other surface of the base sheet 11 and to hold these elastic bodies 21 and 21' between the first and second parts of the film 31.

More specifically, the film 31 is bent into a substantially U shape, as viewed from a side, at the U-shaped cross-sectional part 31*c* and brought into contact with the first and second protrusions 25 and 25'.

A plurality of first and second contact points 33*a* and 33*b* are arranged at predetermined positions on the outer surface of the film 31 such that they are spaced from each other in the pitch direction A. The first and second contact points 33*a* and 33*b* are made of a conductive material, and are mutually connected at the outer surface of the U-shaped cross-sectional part 31*c* to form a part of the conduction pattern serving as an electrical circuit.

The inner surface of the film 31 opposite from the first contact points 33*a* faces the plurality of first protrusions 25 of the first elastic body 21. In the electrical connection member 1 of the first embodiment, the dimensions of each first contact point 33*a* in the pitch direction A and the crosswise direction C are substantially equal to the dimensions of a part of the first elastic body 21 including two first protrusions 25.

The inner surface of the film 31 opposite from the second contact points 33*b* faces the plurality of second protrusions 25' of the second elastic body 21'. In the electrical connection member 1 of the first embodiment, the dimensions of each second contact point 33*b* in the pitch direction A and the crosswise direction C are substantially equal to the dimensions of a part of the second elastic body 21' including two second protrusions 25'.

This means that the inner surface parts of the film 31 opposite from the first and second contact points 33*a* and 33*b* face two first protrusions 25 of the first elastic body 21 and two second protrusions 25' of the second elastic body 21', respectively.

The electrical connection member 1 is interposed between two printed wiring boards 51 and 61. The two printed wiring boards 51 and 61 are connected electrically and mechanically by pressing against the electrical connection member 1 from above and below.

The two printed wiring boards 51 and 61 are respectively provided with conductive portions (conduction pads) 53 and 63 which face the first and second contact points 33*a* and 33*b* of the film 31 in one-to-one correspondence. The conductive portions 53 and 63 are arranged with a space from each other in the pitch direction A. When the electrical connection member 1 is placed between and pressed by the two printed wiring boards 51 and 61, the conductive portions 53 and 63 come into contact with the first and second contact points 33*a* and 33*b*, respectively, in one-to-one correspondence.

The first and second protrusions 25 and 25' are deformed in the pitch direction A when the electrical connection member 1 is held between and pressed by the two printed wiring boards 51 and 61. Therefore, the space between the adjacent first protrusions 25 and the space between the adjacent second protrusions 25' are designed large enough to prevent mutual contact when deformation occurs in them.

The base sheet 11 and the film 31 are formed of a material selected from polyethylene terephthalate (PET) resin, polyimide (PI) resin, polyethylene naphthalate (PEN) resin, aramid resin, polyethylene resin, polypropylene resin, polyphenylene sulfide (PPS) resin, nylon (trade name) resin, fluororesin, a carbon fiber reinforced resin, and the like, or a composite thereof.

The first and second elastic bodies 21 and 21' are formed of a synthetic rubber, a natural rubber, or a gel material. The gel material used for the first and second elastic bodies 21 and 21' is a material in which particles in colloidal solution are solidified into gel state, and is selected from silicon or acrylic materials.

The first and second contact points 33*a* and 33*b* may be formed of a metal sheet having a high modulus of elasticity and a small thickness. The metal material for the first and second contact points 33*a* and 33*b* is selected from nickel, nickel alloys, Monel, nickel vanadium, copper, phosphor bronze, and the like.

The first and second contact points 33*a* and 33*b* may be formed by vapor deposition or plating. The thicknesses of the first and second contact points 33*a* and 33*b* may be on the order of several micrometers.

Figure 3:
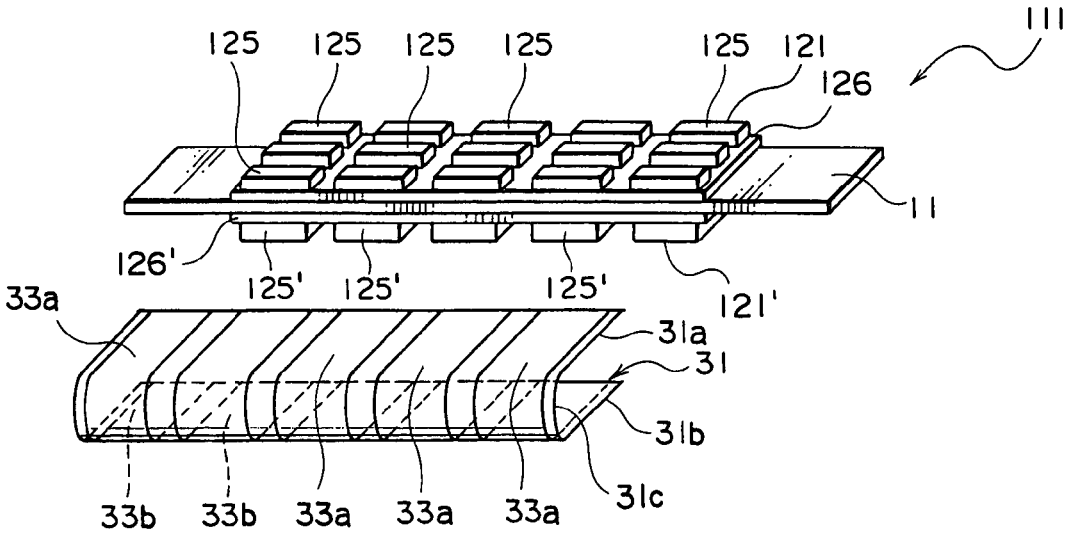
FIG. 3 is a perspective view illustrating an electrical connection member according to a second embodiment of the present invention.

FIG. 3 shows an electrical connection member according to a second embodiment of the present invention. This electrical connection member is only different from the electrical connection member 1 of the first embodiment described with reference to FIGS. 1 and 2 in the configurations of the first and second elastic bodies 21 and 21' shown in FIGS. 1 and 2. Therefore, like parts are designated with same numerals and description thereof will be omitted.

Referring to FIG. 3, a first elastic body 121 of an electrical connection member 111 has a plurality of first protrusions 125, and a long plate-shaped first plate 126 mutually linking the first protrusions 125.

The first elastic body 121 is arranged on one surface of a base sheet 11. The plurality of first protrusions 125 are arranged on one surface of the first plate 126. All of the first protrusions 125 have a same, quadrangular prismatic shape. The first plate 126 is integral with the first protrusions 125. The plurality of first protrusions 125 are arranged on the one surface of the first plate 126 with a space from each other in the pitch direction A and the crosswise direction C. Further, the first protrusions 125 are arranged on the one surface of the first plate 126 such that the longitudinal direction of each first protrusion 125 is parallel with the pitch direction A.

A second elastic body 121' has a same shape as that of the first elastic body 121, and has a plurality of first protrusions 125' and a long plate-shaped first plate 126' mutually linking the first protrusions 125'.

The second elastic body 121' is arranged on the other surface of the base sheet 11. A plurality of second protrusions 125' are arranged on one surface of a second plate 126.

In the second embodiment, each of the first and second contact points 33*a* and 33*b* has a dimension in the pitch direction A which is substantially equal to a dimension in the pitch direction A of the first protrusions 125 and second protrusions 125'. Further, each of the first and second contact points 33*a* and 33*b* has such a dimension in the crosswise direction C as to face three first protrusions 125 and three second protrusions 125', respectively, in the crosswise direction C.

Specifically, in the second embodiment, each inner surface portion of the film 31 opposite from corresponding one of the first contact points 33*a* faces the upper surfaces of the corresponding three first protrusions 125 of the first elastic body 121. Each inner surface portion of the film 31 opposite from corresponding one of the second contact points 33*b* faces the upper surfaces of the corresponding three second protrusions 125' of the second elastic body 121.

The first and second contact points 33*a* and 33*b* of the film 31 and the conductive portions 53 and 63 of the two printed wiring boards 51 and 61 shown in FIG. 1 are connected electrically and mechanically by being in contact with each other in one-to-one correspondence when the electrical connection member 111 is held between the two printed wiring boards 51 and 63 and the printed wiring boards 51 and 63 are pressed against the electrical connection member 111.

Figure 4:
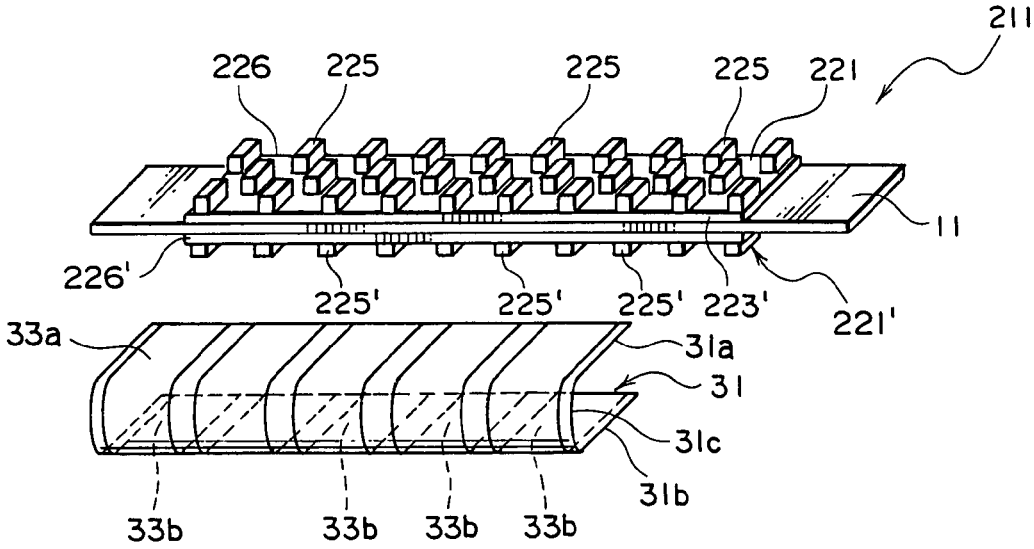
FIG. 4 is a perspective view illustrating an electrical connection member according to a third embodiment of the present invention.

FIG. 4 shows an electrical connection member according to a third embodiment of the present invention. The third embodiment is only different from the first embodiment shown in FIGS. 1 and 2 in the configurations of the first and second elastic bodies 21 and 21' shown in FIGS. 1 and 2. Therefore, like parts are designated with same numerals and description thereof will be omitted.

Referring to FIG. 4, a first elastic body 221 of an electrical connection member 211 has a plurality of first protrusions 225, and a long plate-shaped first plate 226 mutually linking the first protrusions 225.

The first elastic body 221 is arranged on one surface of a base sheet 11. The first protrusions 225 are arranged on one surface of the first plate 226.

The first protrusions 225 have a same, quadrangular prismatic shape. The first plate 226 is integral with the first protrusions 225. The first protrusions 225 are arranged in a staggered manner on the one surface of the first plate 226 with a space from each other in the pitch direction A and the crosswise direction C. Further, the first protrusions 225 are arranged on the one surface of the first plate 226 such that the longitudinal direction of each first protrusion 225 is parallel with the crosswise direction C.

A second elastic body 221' has a same shape as that of the first elastic body 221, and has a plurality of second protrusions 225' and a second plate 226' mutually linking the second protrusions 225'.

The second elastic body 221' is arranged on the other surface of the base sheet 11. The second protrusions 225' are arranged on one surface of the second plate 226'.

In the third embodiment, each of the first and second contact points 33*a* and 33*b* has a dimension in the pitch direction A that is substantially equal to a total dimension in the pitch direction A of corresponding five first protrusions 225 and of corresponding five second protrusions 225'. Further, each of the five first and second contact points 33*a* and 33*b* has such a dimension in the crosswise direction C that each of the contact points 33*a* and 33*b* faces the corresponding five first and second protrusions 225 and 225' in the crosswise direction C.

Specifically, in the second embodiment, each inner surface portion of the film 31 opposite from corresponding one of the first contact points 33*a* faces the upper surfaces of the corresponding five first protrusions 225 of the first elastic body 221. Each inner surface portion of the film 31 opposite from corresponding one of the second contact points 33*b* faces the upper surfaces of the corresponding five second protrusions 225' of the second elastic body 321'.

The first and second contact points 33*a* and 33*b* of the film 31 and the conductive portions 53 and 63 of the two printed wiring boards 51 and 61 shown in FIG. 1 are connected electrically and mechanically by being in contact with each other in one-to-one correspondence when the electrical connection member 111 is held between the two printed wiring boards 51 and 63 and the printed wiring boards 51 and 63 are pressed against the electrical connection member 111.

Figure 5:
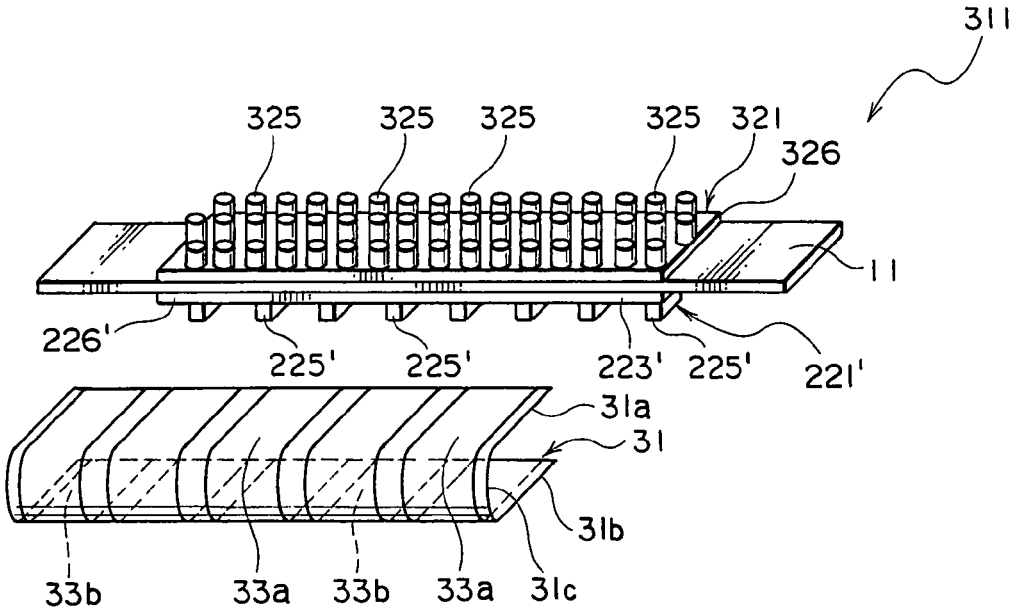
FIG. 5 is a perspective view illustrating an electrical connection member according to a fourth embodiment of the present invention.

FIG. 5 shows an electrical connection member according to a fourth embodiment of the present invention. The fourth embodiment is only different from the third embodiment described with reference to FIG. 4 in the configuration of a first elastic body 321 which is arranged, in place of the first elastic body 221, on one surface of a first plate 223. Therefore, like parts are designated with same reference numerals and description thereof will be omitted.

Referring to FIG. 5, the first elastic body 321 of an electrical connection member 311 has a plurality of first protrusions 325 and a long plate-shaped first plate 323 mutually linking the plurality of first protrusions 325.

The first elastic body 321 is arranged on one surface of a base sheet 11. The plurality of first protrusions 325 are arranged on one surface of the first plate 326.

All the first protrusions 325 have a same, cylindrical shape. The first plate 326 is integral with the first protrusions 325. The first protrusions 325 are arranged on one surface of the first plate 326 with a space from each other in the pitch direction A and the crosswise direction C.

A second elastic body 225' has a same configuration as the first elastic body 321 shown in FIG. 4. The second elastic body 221' is arranged on the other surface of the base sheet 11.

In the fourth embodiment, each of first contact points 33*a* has such dimensions in the pitch direction A and in the crosswise direction C as to face five to eight first protrusions 325 arranged on the first elastic body 321.

Specifically, each inner surface portion of the film 31 opposite from corresponding one of the first contact points 33*a* faces the upper surfaces of the corresponding five to eight first protrusions 325 of the first elastic body 321.

The first and second contact points 33*a* and 33*b* of the film 31 and the conductive portions 53 and 63 of the two printed wiring boards 51 and 61 shown in FIG. 1 are connected electrically and mechanically by being in contact with each other in one-to-one correspondence when the electrical connection member 111 is held between the two printed wiring boards 51 and 63 and the two printed wiring boards 51 and 63 are pressed against the electrical connection member 111.

Figure 6:
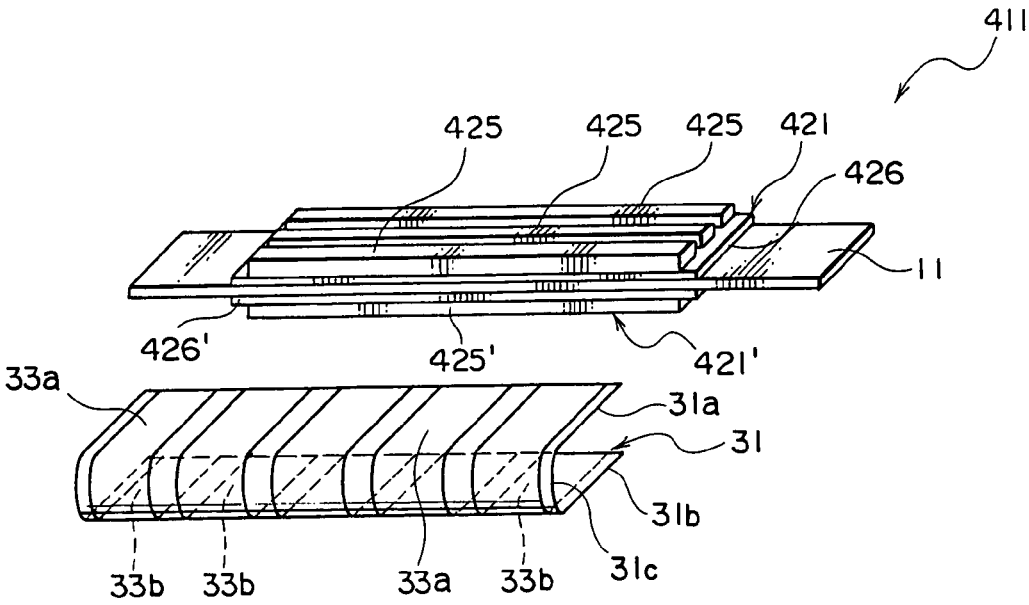
FIG. 6 is a perspective view illustrating an electrical connection member according to a fifth embodiment of the present invention.

FIG. 6 shows an electrical connection member according to a fifth embodiment of the present invention. The fifth embodiment is only different from the first embodiment shown in FIGS. 1 and 2 in the configurations of the first and second elastic bodies 21 and 21' shown in FIGS. 1 and 2. Therefore, like parts are designated with same reference numerals and description thereof will be omitted.

Referring to FIG. 6, a first elastic body 421 of an electrical connection member 411 has a plurality of first protrusion 425, and a long plate-shaped first plate 426 mutually linking the first protrusions 425.

All the first protrusions 425 have a same, elongated rectangular cross-sectional plate shape. The first plate 426 is integral with the first protrusions 425. The plurality of first protrusions 425 are arranged on one surface of the first plate 426 with a space from each other in the crosswise direction C. Further, the first protrusions 425 are arranged on the one surface of the first plate 426 such that the longitudinal direction of each first protrusion 425 is parallel to the pitch direction A.

A second elastic body 421' has a same shape as the first elastic body 421, and has a plurality of second protrusions 425' and a second plate 426' linking the second protrusions 425'. The second protrusions 425' have a quadrangular plate shape elongated in the pitch direction A.

A second elastic body 421' is arranged on the other surface of the base sheet 11. In the fifth embodiment, first and second contact points 33*a* and 33*b* have such dimensions in the crosswise direction C that each of the first and second contact points 33*a* and 33*b* faces corresponding three first and second protrusions 425 and 425' in the crosswise direction C.

Specifically, in the fifth embodiment, each inner surface portion of the film 31 opposite from corresponding one of the first and second contact points 33*a* and 33*b* faces the upper surfaces of the corresponding three first and second protrusions 425 and 425' of the first and second elastic bodies 421 and 421' in the crosswise direction C.

The first and second contact points 33*a* and 33*b* of the film 31 and the conductive portions 53 and 63 of the two printed wiring boards 51 and 61 shown in FIG. 1 are connected electrically and mechanically by being in contact with each other in one-to-one correspondence when the electrical connection member 111 is held between the two printed wiring boards 51 and 63 and the printed wiring boards 51 and 63 are pressed against the electrical connection member 111.

Figure 7:
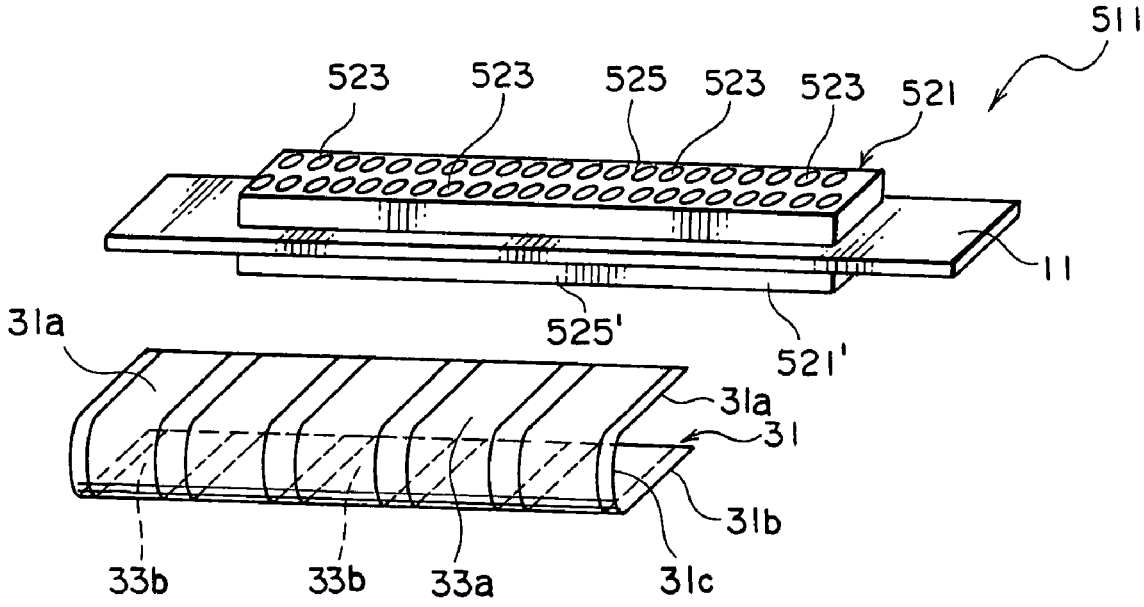
FIG. 7 is a perspective view illustrating an electrical connection member of according to a sixth embodiment of the present invention.

FIG. 7 shows an electrical connection member according to a sixth embodiment in an exploded view. The sixth embodiment is only different from the first embodiment shown in FIGS. 1 and 2 in the configurations of the elastic bodies 21 and 21' shown in FIGS. 1 and 2. Therefore, like parts are designated with same reference numerals and description thereof will be omitted.

Referring to FIG. 7, a first elastic body 521 of an electrical connection member 511 has a long plate shape, and has a plurality of first holes 523 arranged with a space from each other in the pitch direction A and the crosswise direction C of the first elastic body 521, and a plurality of first protrusions 525 formed between the first holes 523 in a continuous fashion.

The first protrusions 525 of the first elastic body 521 are arranged such that each of the first protrusions 525 faces corresponding one of the first contact points 33*a* of the film 31. The first and second contact points 33*a* and 33*b* of the film 31 and the conductive portions 53 and 63 of the two printed wiring boards 51 and 61 shown in FIG. 1 are connected electrically and mechanically by being in contact with each other in one-to-one correspondence when the electrical connection member 111 is held between the two printed wiring boards 51 and 63 and the printed wiring boards 51 and 63 are pressed against the electrical connection member 111.

Figure 8:
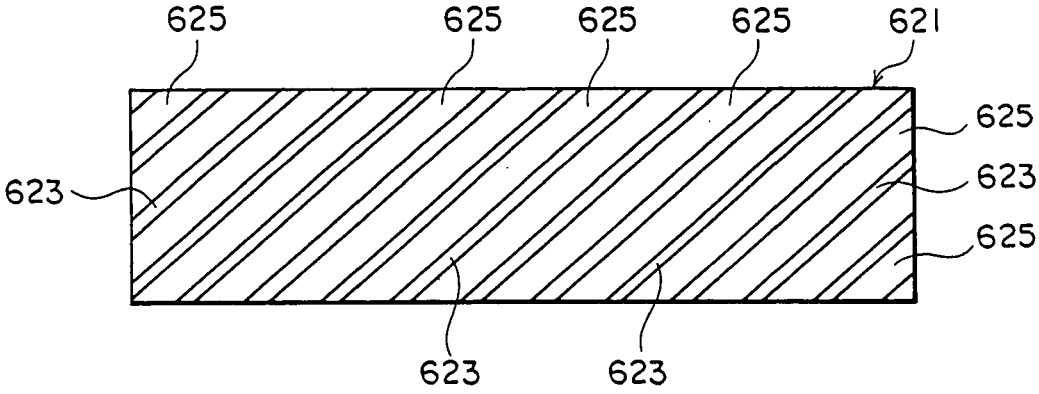
FIG. 8 is a perspective view illustrating an electrical connection member according to a seventh embodiment of the present invention.

FIG. 8 shows a first elastic body 621 according to a seventh embodiment as viewed in plan. The seventh embodiment is only different from the first embodiment shown in FIGS. 1 and 2 in the configuration of the first elastic body 21 shown in FIGS. 1 and 2. Therefore, the description below will be made only of the first elastic body 621 shown in FIG. 8.

The first elastic body 621 has a long plate shape, and has a plurality of first grooves 623 extending in a first specific direction with a space from each other. First protrusions 625 are formed between the adjacent first grooves 623.

In the first elastic body 621 of the seventh embodiment, the plurality of first grooves 623 are formed with a space from each other in an oblique direction intersecting the pitch direction A and the crosswise direction C of the first elastic body 621. The first protrusions 625 are spaced from each other by each of the first groove 623 in an oblique direction intersecting the pitch direction A and the crosswise direction C.

Each inner surface portion of the film 31 opposite from corresponding one of the first contact points 33*a* shown in FIG. 1 faces the upper surfaces of a plurality of the first protrusions 625 intersecting the pitch direction A and the crosswise direction C. The plurality of first grooves 623 may be formed either to have a same width and a same depth, or to have different widths and different depths.

The first elastic body 621 is arranged on the both surfaces of the base sheet 11 as shown in FIGS. 1 and 2, and the film 31 is bent to be wrapped over these first elastic bodies 621. Since the plurality of first protrusions 625 are arranged in the pitch direction A and the crosswise direction C, each inner surface portion of the film 31 opposite from corresponding one of the first and second contact points 33*a* and 33*b* of the film 31 faces the upper surfaces of a plurality of first protrusions 625.

Figure 9:
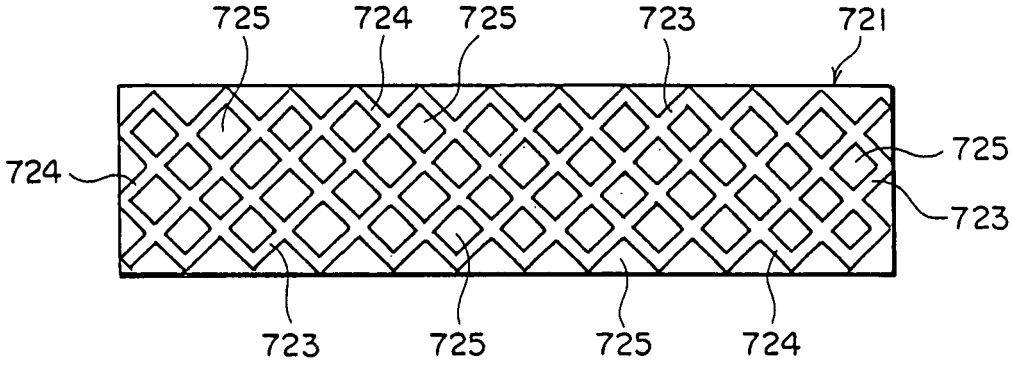
FIG. 9 is a perspective view illustrating an electrical connection member according to an eighth embodiment of the present invention.

FIG. 9 shows a first elastic body 721 of an eighth embodiment as viewed in plan. The eighth embodiment is only different from the first embodiment shown in FIGS. 1 and 2 in the configuration of the first elastic body 21 shown in FIGS. 1 and 2. Therefore, the description below will be made only of the first elastic body 721 shown in FIG. 9.

Referring to FIG. 9, the first elastic body 721 has a long plate shape, and has a plurality of first grooves 723 formed to extend in a first specific direction with a space from each other, and a plurality of second grooves 724 formed with a space from each other and to extend in a second specific direction intersecting the first specific direction.

A first protrusion 725 is formed between each pair of adjacent first grooves 723 and each pair of adjacent second grooves 724.

Specifically, in the first elastic body 721, the first grooves 723 are formed with a space from each other in an oblique direction intersecting the pitch direction A and the crosswise direction C of the first elastic body 721, and the second grooves 724 are formed in a direction perpendicular to or intersecting the first grooves 723. Further, a plurality of first protrusions 725 are formed between the first and second grooves 723 and 724 with a space from each other in an oblique direction intersecting the pitch direction A and the crosswise direction C.

Each inner surface portion of the film 31 opposite from corresponding one of the first and second contact points 33*a* and 33*b* faces a plurality of the first protrusions 725. In the eighth embodiment, the first and second contact points 33*a* and 33*b* face the upper surfaces of the first protrusions 725 arranged to intersect the pitch direction A and the crosswise direction C.

The first elastic body 721 is provided in a pair on the opposite surfaces of the base sheet 11 shown in FIGS. 1 and 2, and a film 31 is bent so as to be wrapped over the first elastic bodies 721. Since the first and second contact points 33*a* and 33*b* of the film 31 are arranged in the pitch direction A and the crosswise direction C, each one of the first and second contact points 33*a* and 33*b* faces a plurality of the first protrusions 725.

Figure 10:
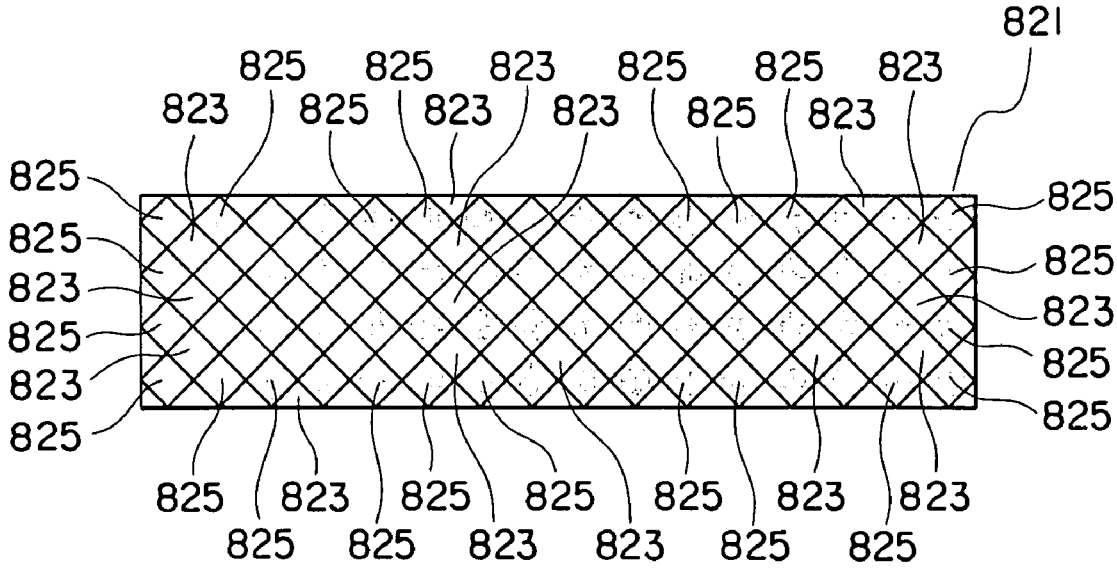
FIG. 10 is a perspective view illustrating an electrical connection member according to a ninth embodiment of the present invention.

FIG. 10 shows a first elastic body 821 according to a ninth embodiment as viewed in plan. The ninth embodiment is only different from the first embodiment shown in FIGS. 1 and 2 in the first elastic body 21 shown in FIGS. 1 and 2. Therefore, the description below will be made only of configuration of a first elastic body 821 shown in FIG. 10.

The first elastic body 821 has a long plate shape, and has a plurality of first grooves 823 formed with an equal space from each other in an oblique direction intersecting the pitch direction A and the crosswise direction C of the first elastic body 821, and a plurality of first protrusions 825 arranged adjacent to the first grooves 823 and with an equal space from each other in an oblique direction intersecting the pitch direction A and the crosswise direction C of the first elastic body 821.

The first grooves 823 and the protrusions 825 are arranged alternately in an oblique direction intersecting the pitch direction A and the crosswise direction C. The first protrusions 825 are arranged such that each one of the first and second contact points 33*a* and 33*b* of the film 31 as shown in FIG. 1 faces a plurality of the first protrusions 825. In the ninth embodiment, first and second contact points 33*a* and 33*b* are arranged such that each one of the first and second contact points 33*a* and 33*b* faces the upper surfaces of a plurality of the first protrusions 825 arranged to intersect the pitch direction A and the crosswise direction C.

The first elastic body 821 is provided in a pair on the opposite surfaces of the base sheets 11 shown in FIGS. 1 and 2, and a film 31 is bent so as to be wrapped over the first elastic bodies 821. Since the first protrusions 825 are arranged in the pitch direction A and the crosswise direction C, each one of the first and second contact points 33*a* and 33*b* of the film 31 faces a plurality of the first protrusions 825.

Figure 11:
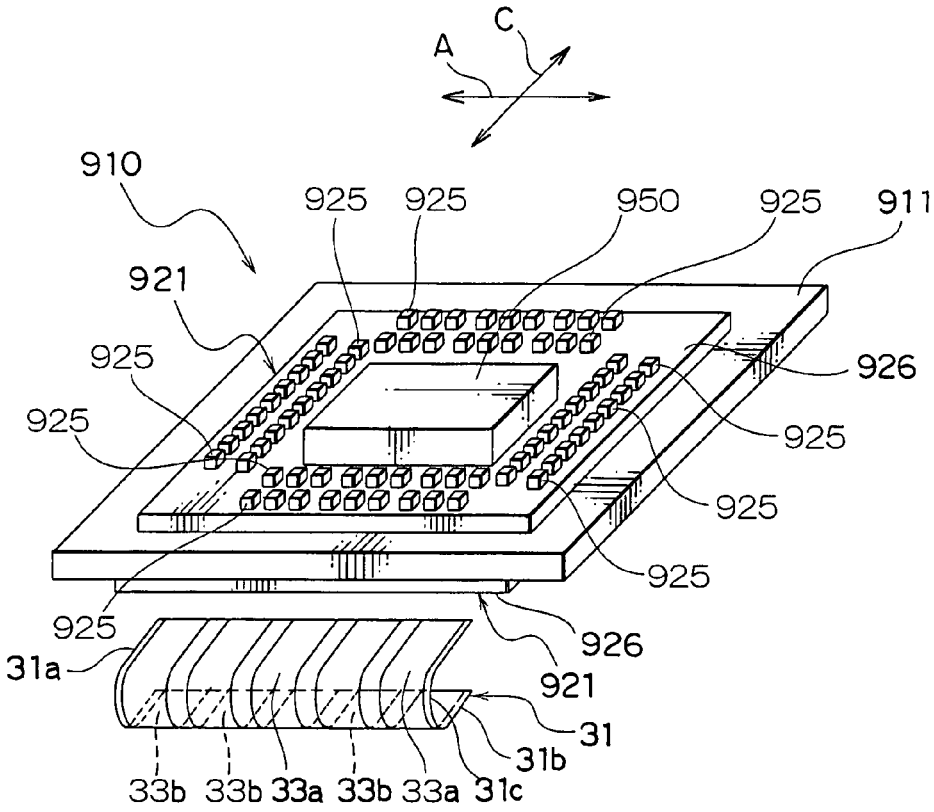
FIG. 11 is a perspective view illustrating an electrical connection member according to a tenth embodiment of the present invention.

FIG. 11 shows an electrical connection device employing an electrical connection member, according to a tenth embodiment of the present invention. Referring to FIG. 11, an electrical connection member 910 has a quadrangular base sheet 911, a first elastic body 921 arranged on one surface of the base sheet 911, and an insulating film 31 arranged on the first elastic body 921.

The film 31 and contact points 33 are the same as the film 31 and the first and second contact points 33*a* and 33*b* described in relation to the first embodiment. The first elastic body 921 is provided on one surface of the base sheet 911. A second elastic body 921 is provided on the opposite surface from the above-mentioned one surface of the base sheet 911 so as to oppose the first elastic body 921. The first elastic body 921 and the second elastic body 921 of the tenth embodiment have a same configuration.

An opening (not shown) is formed in a central portion of the base sheet 911. An electronic device 950 is provided in the opening of the base sheet 911. The first elastic body 921 has a first plate 926 and a plurality of first protrusions 925 arranged on one surface of the first plate 926 so as to protrude upwards from the first plate 926.

The first protrusions 925 are mutually linked by the first plate 926. The electronic device 950 is provided in an opening of the first plate 926. The first protrusions 925 have a same, prismatic shape. The first protrusions 925 are arranged on the four surface areas of the first plate 923 excluding the aperture so that they are spaced from each other in the pitch direction A and the crosswise direction C. Each upper surface portion of the film 31 opposite from corresponding one of the first and second contact points 33*a* and 33*b* faces the upper surfaces of a plurality of the first protrusions 925 of the first elastic body 921.

The electrical connection member 910 connects one printed wiring board 51 and another printed wiring board 61 shown in FIG. 1 electrically and mechanically when the electrical connection member 910 is held between these two printed wiring boards 51 and 61 and the printed wiring boards 51 and 61 are pressed against the electrical connection member 910.

In the electrical connection member 910 of the tenth embodiment, an opening is formed in one of the printed wiring boards 51 and 61 to provide an electronic device 950 therein. The electronic device 950 is connected to a circuit on the other of the printed wiring boards 51 and 61.

Figure 12:
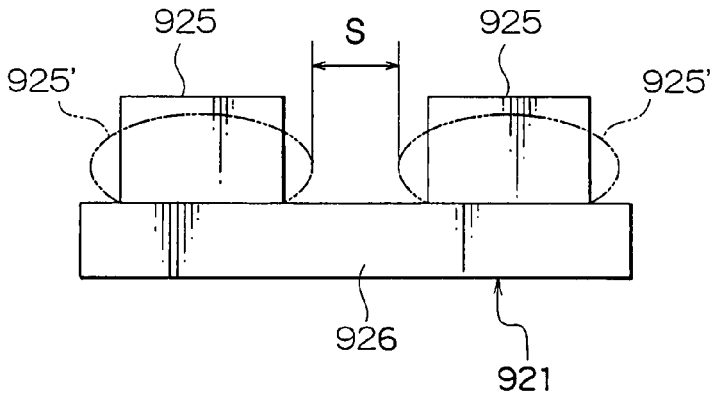
FIG. 12 is a front view for explaining a condition in which an elastic body of an electrical connection member according to the present invention is pressed.

FIG. 12 illustrates a condition in which the protrusions 925 are elastically deformed when the electrical connection member 910 is connected electrically and mechanically to the two printed wiring boards 51 and 61 shown in FIGS. 1 and 2 by pressing the printed wiring boards 51 and 61 against the electrical connection member 910 with the electrical connection member 910 interposed between the printed wiring boards 51 and 61.

Referring to FIG. 12, it is envisageable that the contact between the contact points 33 of the film 31 and the conductive portions 53 and 63 of the two printed wiring boards 51 and 61 will not be held stable if the first protrusions 925 contact with each other and the contact between the protrusions 925 affects deformation of the first protrusions 925. In this case, the design is made such that the first protrusions 925 are spaced from each other by a predetermined distance S.

Specifically, the first protrusions 925 are designed to have such a width that the first protrusions 925 will not contact with each other when the two printed wiring boards 51 and 61 are pressed against the electrical connection member 910 with the electrical connection member 910 interposed between them.

By being spaced from each other by the distance S, the first protrusions 925 are prevented from contacting with each other due to their deformation, and thus the contact between the contact points 33 of the film 31 and the conductive portions 53 and 63 of the two printed wiring boards 51 and 61 can be held in a stable state.

For example, when a dimension of deformation of the first protrusions 925 deformed by being pressed toward the base sheet 911 is greater than 0 mm and equal to or smaller than 0.5 mm, the distance S between the adjacent first protrusions 925 may be set so as to meet the range of the amplitude of deformation (the dimension of deformation) of the first protrusions 925.

The setting of the distance S between the first protrusions 925 as described above is applicable to the first and second protrusions 25, 125, 225, 325, 425, 625, and 725 of the first through the fifth embodiments, the seventh embodiment, and the eighth embodiment.

The elastic bodies are not limited to those described in relation to the first through the tenth embodiments, and may be designed to have protrusions with various other shapes such as a circle, a star, a donut, and a cross as viewed from the top. Although the first and second elastic bodies have protrusions protruding substantially vertically to the pitch direction and the crosswise direction as viewed in cross section, they may be formed to have protrusions protruding substantially obliquely.

Further, as described in relation to the first through the tenth embodiments, even if the electrical connection member is assembled with the first and second contact points of the film being slightly misaligned with respect to the first and second elastic bodies in position in the pitch direction, the electrical connection member is allowed to provide stable contact force because each of the first and second contact points is in contact with a plurality of the first and second protrusions.

Accordingly, the electrical connection member, which can obtain enough force required for electrical connection between the objects to be connected, is able to provide electrically stable connection between the objects to be connected.

In addition, the electrical connection member is able to obtain stable contact force for following the warpage or deformation of the objects to be connected by means of elastic deformation of the first and second elastic bodies, and thus is able to keep an electrically stable contact condition.

Further, the present invention makes it possible to utilize an elastic body formed of rubber, a gel material or the like in common for various types of the electrical connection member. Accordingly, only one type of molding die need be prepared so that various types of electrical connection members with different pitches can be manufactured only by changing the distance in the pitch direction between the contact points arranged on the film.

Further, according to the present invention, the man-hours and cost required for production of an electrical connection member can be reduced since the electrical connection member with a newly set distance in the pitch direction can be manufactured quickly.

Further, it is made possible to provide various types of electrical connection members with different lengths in the pitch direction only by changing the positions of the first and second contact points arranged on the film.

Still further, the electrical connection member according to the present invention can be manufactured with the use of a common molding die for the first and second elastic bodies and with the use of a common assembly jig regardless of the length in the pitch direction of the contact points, by wrapping the film on the first and second elastic bodies and arranging the first and second elastic body portions consecutively with a space from each other in the pitch direction and arranging a plurality of the first and second protrusions with a space from each other in a direction orthogonal to the pitch direction.

It is expected that the size reduction of the electrical connection member and the reduced pitch in the pitch direction will cause the positional misalignment to occur more easily between the film and the first and second elastic bodies. However, the first and second elastic bodies according to the present invention are able to provide stable electrical connection since a plurality of first and second protrusions can be positioned to face each one of the first and second contact points.

The electrical connection member according to the present invention is applicable as a connector for an IC memory card, a contact for a liquid crystal panel, and an anisotropic conductive connector for electrically connecting an electronic device surface-mounted on an LSI.

What is claimed is:

1. An electrical connection member for electrically connecting first and second objects to be connected to each other, comprising:

a base sheet;

an insulating first elastic body arranged on one surface of the base sheet;

an insulating second elastic body arranged on another surface of the base sheet; and an insulating film comprising:

a first part arranged on the first elastic body;

a second part arranged on the second elastic body; and a U-shaped cross-sectional part linking the first and second parts;

wherein:

the first part comprises a plurality of first contact points for contact with the first object to be connected;

the second part comprises a plurality of second contact points for contact with the second object to be connected;

the first elastic body comprises a plurality of first protrusions which protrude toward the first contact points;

the second elastic body comprises a plurality of second protrusions which protrude toward the second contact points;

the first contact points and the second contact points are connected to each other at a surface of the U-shaped cross-sectional part; and the first protrusions and the second protrusions are brought into contact with an inner surface of the U-shaped cross-sectional part.

2. The electrical connection member according to claim 1, wherein the insulating second elastic body is arranged between the base sheet and the second part.

3. The electrical connection member according to claim 1, wherein the first elastic body has a plurality of holes, the first protrusions being formed between the holes.

4. An electrical connection device having an electrical connection member according to claim 1 provided at each of a plurality of edges of the base sheet having a quadrangular shape.

5. The electrical connection member according to claim 1, wherein the first elastic body has a plate mutually linking the first protrusions.

6. The electrical connection member according to claim 5, wherein the first protrusions are arranged on one surface of the plate, parallel to and with a space from each other.

7. The electrical connection member according to claim 6, wherein the first protrusions are arranged on one surface of the plate in a staggered manner with a space from each other.

8. The electrical connection member according to claim 1, wherein the first elastic body has a plurality of first grooves extending in a first direction with a space from each other, the first protrusions being formed between adjacent pairs of the first grooves.

9. The electrical connection member according to claim 8, wherein the first elastic body has a plurality of first grooves extending in a first direction with a space from each other, and a plurality of second grooves extending, with a space from each other, in a second direction intersecting the first direction, the first protrusions being formed between adjacent pairs of the first grooves and adjacent pairs of the second grooves.

* * * * *